US010208511B2

(12) United States Patent
Vanliefde et al.

(10) Patent No.: US 10,208,511 B2
(45) Date of Patent: Feb. 19, 2019

(54) LOCKABLE DRAWER CABINET

(71) Applicant: Belintra, Inc., Semmerzake (BE)

(72) Inventors: Charlotte Vanliefde, Semmerzake (BE); Peter Van der Vennet, Semmerzake (BE)

(73) Assignee: Belintra, Inc., Semmerzake (BE)

( * ) Notice: Subject to any disclaimer, the term of this patent is extended or adjusted under 35 U.S.C. 154(b) by 0 days.

(21) Appl. No.: 15/679,313

(22) Filed: Aug. 17, 2017

(65) Prior Publication Data

US 2018/0051487 A1 Feb. 22, 2018

Related U.S. Application Data

(60) Provisional application No. 62/376,188, filed on Aug. 17, 2016.

(51) Int. Cl.

| | |
|---|---|
| ***E05B 47/00*** | (2006.01) |
| ***E05B 63/24*** | (2006.01) |
| ***E05B 65/46*** | (2017.01) |
| ***E05C 19/12*** | (2006.01) |
| ***A47B 88/453*** | (2017.01) |
| ***A47B 88/919*** | (2017.01) |
| ***E05B 65/462*** | (2017.01) |

(52) U.S. Cl.

CPC ..... *E05B 65/46* (2013.01); *A47B 88/453* (2017.01); *A47B 88/919* (2017.01); *E05B 47/0012* (2013.01); *E05B 63/24* (2013.01); *E05B 63/244* (2013.01); *E05B 65/462* (2013.01); *E05C 19/12* (2013.01)

(58) Field of Classification Search

CPC ..... E05B 65/45; E05B 65/462; E05B 65/463; E05B 65/464; E05B 47/0012; A47B 88/453; A47B 88/457

See application file for complete search history.

(56) References Cited

U.S. PATENT DOCUMENTS

| | | | | | |
|---|---|---|---|---|---|
| 5,782,545 | A * | 7/1998 | Kahara | E05B 65/464 | 312/217 |
| 7,144,092 | B1 * | 12/2006 | Chang | E05B 65/462 | 312/217 |
| 2004/0051425 | A1 * | 3/2004 | Chen | E05B 65/463 | 312/217 |
| 2006/0132005 | A1 * | 6/2006 | Cheng | E05B 65/462 | 312/219 |
| 2006/0186776 | A1 * | 8/2006 | Tsai | A47B 67/04 | 312/408 |
| 2007/0035218 | A1 * | 2/2007 | Chen | E05B 65/463 | 312/221 |
| 2007/0283733 | A1 * | 12/2007 | Ratkus | E05B 47/0012 | 70/78 |
| 2008/0074017 | A1 * | 3/2008 | Ruan | E05B 65/464 | 312/221 |
| 2010/0106291 | A1 * | 4/2010 | Campbell | E05B 47/0002 | 700/231 |

(Continued)

*Primary Examiner* — Daniel J Rohrhoff

(74) *Attorney, Agent, or Firm* — Peter J. Ims; Westman, Champlin & Koehler, P.A.

(57) ABSTRACT

A cabinet having lockable drawers includes a frame and one or more drawers supported by the frame. At least one drawer has a releasable latching mechanism for securing the drawer in a locked position by way of engagement of the releasable latching mechanism engaging with a corresponding portion positioned on the frame.

20 Claims, 4 Drawing Sheets

(56) References Cited

U.S. PATENT DOCUMENTS

| | | | | |
|---|---|---|---|---|
| 2011/0140831 | A1* | 6/2011 | Michael | A61J 7/0084 340/3.31 |
| 2014/0167575 | A1* | 6/2014 | Freimuth | E05B 65/464 312/220 |
| 2016/0160535 | A1* | 6/2016 | Haidvogl | A47B 88/40 312/212 |

* cited by examiner

LOCKABLE DRAWER CABINET

CROSS REFERENCE TO RELATED APPLICATION(S)

This application claims the benefit of U.S. Provisional Patent Application Ser. No. 62/376,188 entitled LOCKABLE DRAWER CABINET that was filed on Aug. 17, 2016, the contents of which are incorporated by reference in its entirety.

BACKGROUND

The present disclosure relates to cabinets having drawers that are lockable. More specifically, the present disclosure relates to cabinets provided with a frame and a drawer supported by the frame wherein the cabinets comprise a releasable latching mechanism for the drawer.

The safe storage of medicines is a paramount concern in hospital environments to reduce the risk of medicine theft. In order to reduce the risk of medicine theft, safe medicine storage solutions exist. However, the existing solutions are generally inconvenient, and/or unsafe. Accordingly, there is a need for solutions which allow for the improved safe storage of medicines.

SUMMARY

An aspect of the present disclosure relates to a cabinet configured to provide safe storage of medicines in an efficient manner. The cabinet comprises a frame and at least one drawer supported by the frame. The cabinet further comprises a releasable latching mechanism, also referred to an as "RLM" for the drawer. The RLM may be configured to automatically lock the drawer in a drawer-closed position. The RLM comprises a first member and a second member, where the first member is disposed on the frame and is configured to engage and releasably latch to the second member which is disposed on the drawer. In some embodiments, the first and/or second members may be dismountable.

The position of the first member may be controllably fixable (or securable) in response to a signal. The positions in which the member is fixable include a forward latching position and retracted release position. The second member may then be coupled to a compliant member configured to bias the second member in a forward position for latching with the first member in the forward latching position. Further, at least one drawer may be attached to the frame by at least one glide that is a self-closing glide.

The cabinet may further comprise a rotary actuator configured to rotate the first member between the forward latching position and the retracted release position responsive to the signal. The second member may also be in revolute connection with the drawer and the compliant member which revolutely biases the second member in the forward position.

Each of the first and second members may comprise a hook portion configured to latchingly engage with the second or first member, respectively.

The first member may also be able to adopt the forward latching position when the drawer is open, thereby allowing the drawer to be locked when the drawer is returned to the drawer-closed position.

Another aspect of the present disclosure relates to the cabinet described herein and further comprising a plurality of drawers. At least of the plurality of drawers, and preferably at least two of the drawers may have a corresponding releasable latching mechanism. Each first member of the respective releasable latching mechanism is controllably fixable between the forward latching position and retracted release position responsive to the same signal set. Additionally, a corresponding rotary actuator controllably fixes the position of each first member of the respective releasable latching mechanism between the forward latching position and retracted release position.

The cabinet may also comprise drawers of different types, for example, there may be two drawer types. Drawers of the first drawer type comprise releasable latching mechanism of a first RLM type, the first member of releasable latching mechanism of the first RLM type being controllably fixable in response to a first signal set between a forward latching position and a retracted release position. Drawers of the second drawer type are disposed with an releasable latching mechanism of a second RLM type, the first member of the releasable latching mechanism of the second RLM type being controllably fixable in response to a second signal set between a forward latching position and a retracted release position. A third drawer type is also considered where the third drawer type does not have a releasable latching mechanism and remains unlocked. Additionally rotary actuators may be incorporated in the same manner as above in order to controllably fix the position of each respective releasable latching mechanism in order to independently control locking of the drawers.

Yet another aspect of the present disclosure relates to a method of locking and unlocking the at least one drawer. The method comprising providing a drawer in an open position, the drawer being disposed with an RLM having a first member and a second member, the first member and the second member being placed in a forward position and closing the drawer, and while closing the drawer, maintaining the first member in a forward position, and pushing the second member to a retracted position by means of the first member. The method further comprises returning the second member to its forward position by means of a compliant member, and latchingly engaging the hook portion of the second member by means of a hook portion of the first member when the drawer is fully closed, thereby locking the drawer.

Unlocking or opening the drawer comprises providing a drawer in a closed position, the drawer being disposed with an RLM having a first member and a second member, the first member and the second member being in a forward position, and a hook portion of the first member latchingly engaging with a hook portion of the second member and moving the first member from its forward position to a retracted position by means of a rotary actuator, thereby unlocking the drawer. Once unlocked, the drawer can be opened.

DETAILED DESCRIPTION

Figure 1:
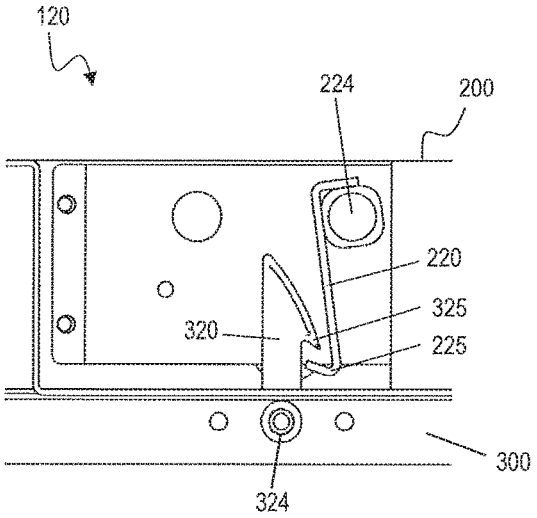
FIG. 1 is a side view of a releasable latching mechanism for a cabinet according to the present disclosure.

The present disclosure will be described herein with respect to particular embodiments, however the disclosure is not limited thereto but only by the claims.

As used herein, the singular forms "a", "an", and "the" include both singular and plural referents unless the context clearly dictates otherwise.

The terms "comprising", "comprises" and "comprised of" as used herein are synonymous with "including", "includes" or "containing", "contains", and are inclusive or open-ended and do not exclude additional elements or method steps. The terms "comprising", "comprises" and "comprised of" when referring to elements or method steps cited herein also include embodiments which "consist of" said elements or method steps cited herein.

Furthermore, the terms first, second, third and the like as used herein are used for distinguishing between similar elements and not necessarily for describing a sequential or chronological order, unless specified. It is to be understood that the terms so used are interchangeable under appropriate circumstances and that the embodiments of the disclosure described herein are capable of operation in other sequences than described or illustrated herein.

The term "about" as used herein when referring to a measurable value such as a parameter, an amount, a temporal duration, and the like, is meant to encompass variations of +/−10% or less, preferably +/−5% or less, more preferably +/−1% or less, and still more preferably +/−0.1% or less of and from the specified value, insofar such variations are appropriate to perform in the disclosed disclosure. It is to be understood that the value to which the modifier "about" refers is itself also specifically, and preferably, disclosed.

The recitation of numerical ranges by endpoints includes all numbers and fractions subsumed within the respective ranges, as well as the recited endpoints.

Unless otherwise defined, all terms used in disclosing the disclosure, including technical and scientific terms, have the meaning as commonly understood by one of ordinary skill in the art to which this disclosure belongs. By means of further guidance, definitions for the terms used in the description are included to better appreciate the teaching of the present disclosure. The terms or definitions used herein are provided solely to aid in the understanding of the disclosure.

A lockable drawer cabinet 100 has a releasable locking mechanism 120 as illustrated generally in FIGS. 1-6. A cabinet 100 according to the present disclosure comprises a drawer 300 and a frame 200. The drawer 300 is generally supported by the frame 200. Also, the drawer 300 is generally disposed with a releasable latching mechanism 120. The releasable latching mechanism 120 is configured to lock the drawer 300 in a drawer-closed position. The releasable latching mechanism 120 comprises a first member 220 and a second member 320. The first member 220 is disposed in relation to, or otherwise positioned on the frame 200 and is configured to engage with and releasably latch to the second member. 320 The second member 320 s disposed in relation to, or otherwise positioned on the drawer 300.

The position of the first member 220 may be controllably fixable and responsive to a signal between a forward latching position 222 and a retracted release position 221. In the forward latching position 222, the first member 220 can latchingly engage the second member 320. In the retracted release position 221, the first member 220 can release the second member 320.

The second member 320 may then be coupled to a compliant member configured to bias the second member in a forward position for latching with the first member in the forward latching position 322.

Accordingly, the drawer 300 may be locked and unlocked efficiently and with relative ease. The term "cabinet" as used herein refers to a device for storing items. The cabinet 100 comprises one or more drawers 300 and at least one releasable latching mechanism per drawer 300 and a frame 200 that supports the drawers 300. The frame 200 may be further provided with a set of wheels for ease of transport.

The term "releasable latching mechanism" (also referred to as an "RLM" hereinafter) as used herein refers to an electromechanical device which is configured to lock/unlock a drawer. In particular, locking a drawer 300 occurs in a drawer-closed position. An RLM 120 typically comprises the first member 220 and the second member 320, as described throughout this disclosure.

Referring to the embodiment illustrated in FIGS. 1 and 2, FIG. 1 illustrates a close-up of a part of a cabinet 100. The cabinet comprises the frame 200 and at least one drawer 300. The drawer 300 is reversibly lockable relative to the frame 200 by means of a releasable latching mechanism 120. The releasable latching mechanism 120 comprises a first member 220 and a second member 320. The first member 220 is rotatably attached to the frame 200. In particular, the first member 220 can be rotated and fixed at a particular angle by means of a servomotor 224. The second member 320 is rotatably attached to the drawer 330 by a revolute joint 324 and is biased in a forward position by means of a torsion spring. The second member 320 comprises a hook portion 325 which is configured to latchingly engage with a hook portion 225 of the first member 220.

Figure 2A:
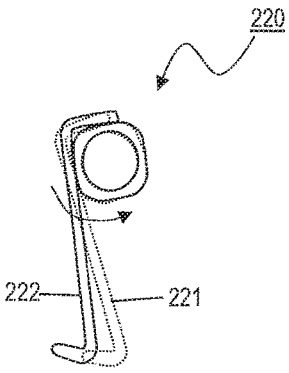
FIG. 2A is a side view of a first member of the releasable latching mechanism in a forward and retracted position.
Figure 2B:
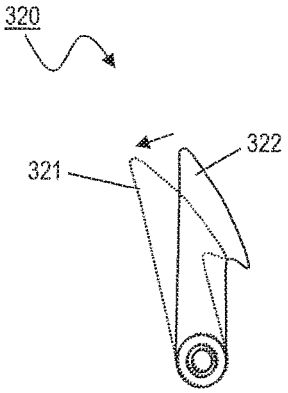
FIG. 2B is a side view of a second of the member releasable latching mechanism in a forward and retracted position.

FIG. 2A illustrates the position of the first member 220 in a forward 222 and retracted 221 position. FIG. 2B shows the position of the second member 320 in a forward 322 and retracted 321 position.

The second member 320 may also be in revolute connection with the drawer 300 and the compliant member is then configured to revolutely bias the second member 320 in the forward position 322. The revolute connection typically provides rotation around a single axis i.e. the revolute connection typically allows for one rotational degree of freedom. The compliant member is a member configured to exert torque in response to a rotation away from a neutral position, such as a spring. For example, the neutral position of the compliant member in its forward position may also comprise a torsion spring. Thus, the second member 320 may be efficiently biased towards the forward position 322.

The second member 320 may also comprise a hook portion 325. The hook portion 325 is configured to latchingly engage with the first member 220, allowing the drawer or drawers 300 to be efficiently locked. Similarly, the first member may also comprise a complimentary hook portion 225 for engaging the first member 220 and second member 320 for locking.

Figure 3A:
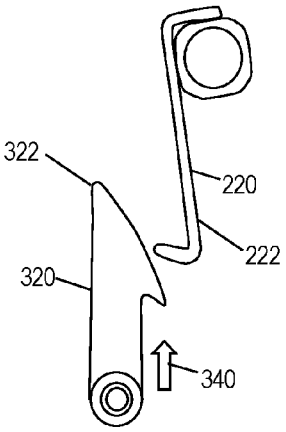
FIG. 3A is a side view of a second members of the releasable latching mechanism being moved toward a locking position with a first member of the releasable latching mechanism.
Figure 3B:
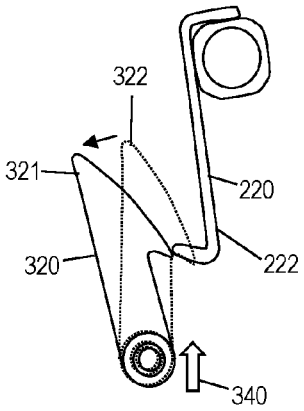
FIG. 3B is a side view of the first and second members of the releasable latching mechanism beginning to engage while the second member is moved toward the locking position.
Figure 3C:
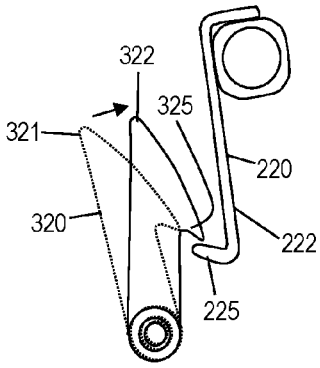
FIG. 3C is a side view of the first and second members of the releasable latching mechanism in the locking position.

Referring to the embodiment illustrated in FIG. 3A-3C, the drawer 300 can be locked in a series of steps by engagement of the releasable latching mechanism 120. The first member 220 is in a forward position 222, and the second member 320 is in a forward position 322. The second member is rotatably attached to a drawer, and is biased in the forward position 222 by way of a torsion spring. The movement of the drawer is indicated by a drawer movement indicator 340. In particular, as illustrated in FIG. 3A, the position of the drawer 300 and movement is such that the first member 222 and the second member 322 are about to engage.

In FIG. 3B, the drawer 300 continues to move in the direction indicated by the drawer movement indicator 340. The direction in which the drawer moves is the same as in FIG. 3A. The first member 220 and the second member 320 engage in FIG. 3B. In particular, the first member 220 is in a forward position 222, and the second member 320 engages with the first member 220. Due to this engagement, the first member 220 exerts a force against a rounded portion of the second member 320. This causes the compliant member to yield and the second member 320 to rotate from a forward position 322 to a retracted position 321. The second member 320 movement is indicated by a second member movement indicator 323.

As illustrated in FIG. 3C, the second member 320 and the first member 220 latchingly engage. In particular, both the first member 220 and the second member 320 comprise a hook portion 225, 325. As a drawer to which the second member 320 is rotatably attached moves in the direction of the drawer movement indicator 340, a point is crossed at which the hook portion 325 of the second member moves beyond the hook portion 225 of the first member. When this point is crossed, the second member 320 rotates from the retracted position 321 to the forward position 322 under the force of the torsion spring by which the second member 320 is biased in the forward position 222. This rotational movement is indicated by the second member movement indicator 323 of FIG. 3C. The hook portions of the first member and second members are now engaged, and the drawer is locked.

Figure 4A:
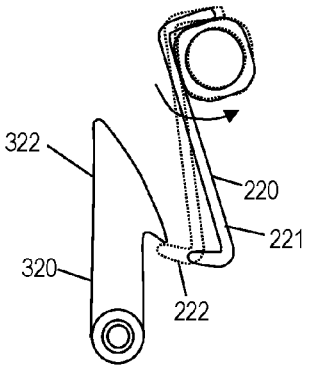
FIG. 4A is a side view of a first member of the releasable latching mechanism rotated from an engagement with the second member of the releasable latching mechanism.
Figure 4B:
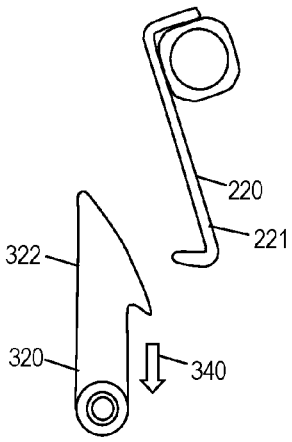
FIG. 4B is a side view of the second member of the releasable latching mechanism displaced from the first member of the releasable latching mechanism.

Referring to FIG. 4A-B, a drawer can be unlocked in a series of steps as illustrated in FIGS. 4A to 4B, respectively, by means of a releasable latching mechanism 120. In FIG. 4A, unlocking is shown. In particular, the first member 220 is rotatably moved from a forward position 222 to a retracted position 221, as shown by a first member movement indicator 223. The second member 320 continues to be in its forward position 222. Through the movement of the first member 220 to its retracted position 221, the first and second members no longer latchingly engage. Accordingly, the releasable latching mechanism 120 is unlocked. In FIG. 4B, the releasable latching mechanism 120 is open: the first member 220 is in its retracted position 221, and the second member 320 is in its forward position 321. The drawer can be opened, as shown by a drawer movement indicator 340.

The cabinet 100 may further comprise an actuator 224, such as a rotary actuator for converting an electrical signal to rotational movement. The rotary actuator 224 is configured to rotate the first member 220 between the forward latching position 222 and the retracted release position 221 responsive to the signal. For example, the rotary actuator may be a servomotor or a stepper motor. The rotary actuator illustrated in the figures is a servomotor 224. This allows the drawers 300 to be locked efficiently and in response to a selected signal, such as a signal provided by a pharmacy dispensing computer.

The drawer 300 may be attached to the frame 200 with at least one glide mechanism. The glide mechanism may be a self-closing glide. Thus, the drawer 300 of which the RLM 120 comprises the first member 220 in a forward latching position 222 can be locked automatically when an extended drawer 300 is released by a user. In particular, the self-closing glide may exert a force on the drawer 300, thereby pulling the drawer 300 to a drawer-closed position, in which the second member 320 rotatably attached to the drawer can latchingly engage the first member 220 in the forward latching position 222, 322. The self-closing glides allows for enhanced security of storage of items, for example medicines, which are stored in the cabinets 100 disclosed herein.

Figure 5:
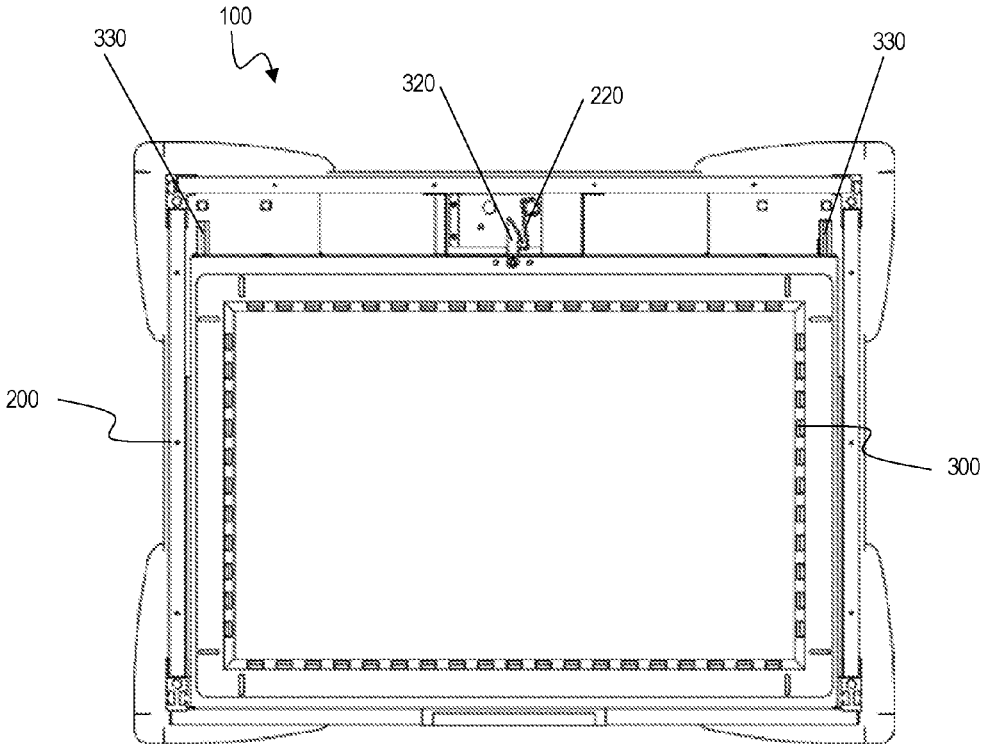
FIG. 5 is a top view of a cabinet comprising the releasable latching mechanism.

Referring to the embodiment illustrated in FIG. 5, the cabinet 100 comprises the frame 200 and the drawer 300. The drawer 300 can be slidably opened relative to the frame 200 by means of telescopic slides 330. The telescopic slides 330 comprise an automatic closing mechanism. The automatic closing mechanism comprises a spring and it is configured to slidably pull the drawer 300 into the frame 200. The cabinet further comprises the releasable latching mechanism 120 comprising the first member 220, and the second member 320, as described throughout this disclosure.

The first member 220 may be able to adopt the forward latching position 222 when the drawer 300 is open. This allows the drawer 300 to be locked when the drawer is returned to the drawer-closed position. Additionally, or alternatively, the first member 220 may be able to adopt the forward latching position 222 when the drawer 300 is closed. This allows the drawer 300 to be locked when the drawer 300 is in the drawer-closed position.

The RLM 120 for each drawer 300 may be operationally coupled with an I/O interface 420. The term "I/O interface" as used herein refers to a communications module. The communications module may be configured for receiving and/or transmitting signals chosen from the list including, but not limited to, radio wave signals, infrared signals, millimeter wave signals, microwave signals, and guided-wire signals. In some embodiments, the I/O interface 420 is configured for communicating by means of a standard chosen from the list including, but not limited to, a wifi standard and a Bluetooth standard.

Figure 6:
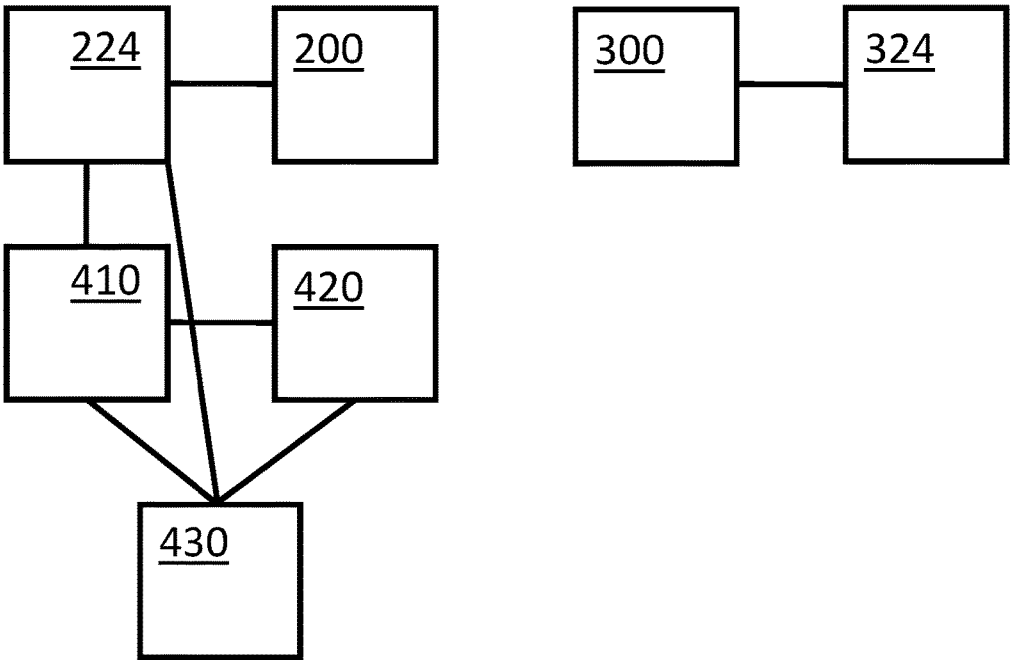
FIG. 6 is a schematic representation of the releasable latching mechanism.

Referring to FIG. 6, which is a schematic representation of a releasable latching mechanism 120 comprising a first member 220, and a second member 320, the first member 220 is operationally coupled to a servomotor 224. The servomotor 224 is configured for reversibly moving the first member 220 between a retracted position and a forward position. The servo motor locks the position of the first member 220 at the retracted position and at a forward position. The servomotor 224 is operationally coupled to a processor 410. The processor is operationally coupled to an I/O interface 420. The I/O interface is configured receiving a locking and unlocking signal. Upon receipt of a locking or unlocking signal, the I/O interface 420 transfers the locking or unlocking signal to the processor 410, which in turn actuates the servomotor 224 accordingly.

The processor 410 is configured for detecting whether the first member 220 is in a retracted position or in a forward position. This allows efficient locking and unlocking of a drawer. In particular for unlocking, when the first member 220 is in a retracted position, the processor does not forward the unlocking signal to the servomotor 224, as the releasable latching mechanism 120 is already unlocked. When the first member is 220 is in a forward position, the processor forwards the unlocking signal to the servomotor 224, and the first member 220 moves from its forward position to its retracted position, thereby unlocking the drawer.

For locking, when the first member 220 is in a retracted position, the processor forwards the locking signal to the servomotor 224, and the first member 220 moves from its retracted position to its forward position, thereby locking the drawer. When the first member 220 is in a forward position, the processor does not forward the locking signal to the servomotor 224, as the releasable latching mechanism 120 is already locked.

The servomotor 224, the processor 410, and the I/O interface 420 are powered by an energy source 430, example of which include but are not limited to a battery. The second member 300 is operationally coupled to a torsion spring 324. The torsion spring 324 is a passive component, i.e. it does not require energy for its operation. The torsion spring 324 is configured for exerting a torsion force on the second member in the direction pointing from the second member's retracted position to the second member's forward position.

The first 220 and/or second member 320 of the RML may also be dismountable from the frame 200 and the drawer 300, respectively. Accordingly, the first 220 and/or second member 320 may be readily changed in case of a defect, or when the configuration of the cabinet 100 is changed. This allows versatile locking and unlocking configurations with one or more drawer 300 of one or more types. For instance, a cabinet may be configured such that some drawers respond to a first signal set, some drawers respond to a second signal set, and some drawers are not disposed with an RLM, and are therefore always open.

The cabinet 100 may comprise one or more drawers 300. For example, the cabinet may comprise two, three, four, five, six or more drawers 300. One or more, or at least two of the drawers 300 may comprise an RLM 120. The first member 220 of each respective RLM 120 may be controllably fixable between the forward latching position 222 and the retracted position 221 and responsive to the same signal set. This allows multiple drawers 300 to be locked or unlocked simultaneously. It is also contemplated that two or more RLMs 120 may be controllably fixable between the forward latching position and the retracted position responsive to a different signal set, allowing the two different drawers 300 to be locked or unlocked depending on the signal set.

The cabinet 100 may be configured such that one rotary actuator 224 is configured to controllably fix the position of each first member 220 of the respective RLM 120 between the forward latching position 222 and the retracted release position 221.

The cabinet 100 may also comprise one or more drawers of different drawer types. For example, a first drawer type, and a second drawer type. The drawers 300 of the first drawer type may disposed with an RLM 120 of a first RLM type and the drawers 300 of the second drawer type are disposed with an RLM 120 of a second RLM type. The first member 220 of RLMs of the first RLM type is controllably fixable and responsive to a first signal set between a forward latching position 222 and a retracted release position 221. The first member 220 of the RLM 120 of the second RLM type is controllably fixable and responsive to a second signal set between a forward latching position 222 and a retracted release position 221. The first signal set may be distinct from the second signal set, allowing the cabinet 100 to be provided with two sets of drawers 300, each set of drawers being individually lockable and unlockable.

The cabinet 100 may also comprise a third drawer type. The third drawer type is not disposed with any RLM 120, allowing drawers of the third drawer type to generally remain always unlocked.

The cabinet 100 having multiple drawers 100 comprises two rotary actuators 224. A first rotary actuator controllably fixes the position of each first member 220 of RLMs 120 of the first RLM type between a forward latching position 222 and a retracted release position 221. A second rotary actuator 224 controllably fixes the position of each first member 220 of RLMs 120 of the second RLM type between a forward latching position 222 and a retracted release position 221. The first rotary actuator may be controllable by means of a first signal set, and the second rotary actuator may be controllable by means of a second signal set. Accordingly, two groups of drawers can be locked and unlocked independent from each other in an effective way.

Another aspect of the present disclosure relates to a method of locking and unlocking a drawer 300 by means of actuating and releasing the RLM 120, respectively. The method comprises the steps illustrated in FIG. 6. To lock the drawer 300, the first member 220 and the second member 320 are placed in a forward position 222, 322, and the drawer 300 moves into the cabinet towards a closed position. The drawer 300 continues towards a closed position and the first member 220 remains in a forward position 322. As the drawer 300 continues towards a closed position, the first member 220 pushes the second member 320 to a retracted position 321. Once the drawer is fully closed, the second member 320 is returned to its forward position 322 by the compliant member. The hook portion 225 of the first member 220 latchingly engages with the hook portion 325 of the second member 320 and the drawer 300 is locked is in the closed position. Reciprocally, unlocking the drawer comprises the locked drawer 300 where the first member 220 and the second member 320 are in a forward, locked position. The first member 220 is moved from its forward position 222 to a retracted position 221 by the rotary actuator 224. The drawer 300 is now unlocked, the hook portions 225 and 325 being unlatched or disengaged from one another and the drawer 300 is opened.

The present disclosure allows the controllable unlocking and locking of a drawer or of multiple drawers in a cabinet that finds particular utility in a hospital for dispensing medicines. When coupled with a mobile pharmacy dispensing computer, a drawer containing the required medicine may be unlocked at a patient bed responsive to the scanning of a barcode on the patient wrist. Medicines may be organized in the cabinet according to location, for instance, medicines for each ward be assigned a different drawer, or according to risk, for instance, harmful medicines may be assigned a drawer different from non-harmful medicines. The dismountable nature of the RLM and/or of the first or second members allows the cabinet drawers to be user configured.

Although the present disclosure has been described with reference to preferred embodiments, workers skilled in the art will recognize that changes may be made in form and detail without departing from the spirit and scope of the disclosure.

What is claimed:

1. A cabinet comprising;

a frame;

a drawer supported by the frame;

a releasable latching mechanism for the drawer wherein the releasable latching mechanism is configured to lock the drawer in a drawer-closed position, and the releasable latching mechanism comprises:

a first member and a second member wherein the first member is positioned in relation to the frame and is configured to engage and releasably latch to the second member which is positioned in relation to the drawer, wherein the second member is in revolute connection with the drawer and the compliant member revolutely biases the second member in the forward position, wherein the position of the first member is controllably fixable in response to a signal between a forward latching position and retracted release position and the second member is coupled to a compliant member configured to bias the second member in a forward position for latching with the first member in the forward latching position.

2. The cabinet according to claim 1, and further comprising a rotary actuator configured to rotate the first member between the forward latching position and the retracted release position responsive to the signal.

3. The cabinet according to claim 1, wherein the second member comprises a hook portion configured to latchingly engage with the first member.

4. The cabinet according to claim 1, wherein the first member comprises a hook portion configured to latchingly engage with the second member.

5. The cabinet according to claims 1, wherein the drawer is attached to the frame by at least one glide that is a self-closing glide.

6. The cabinet according to claim 1, wherein the first member is able to adopt the forward latching position when the drawer is open, thereby allowing the drawer to be locked when the drawer is returned to the drawer-closed position.

7. The cabinet according to claim 1, and further comprising a plurality of drawers each disposed with a releasable latching mechanism, wherein each first member of a respective releasable latching mechanism is controllably fixable between the forward latching position and retracted release position responsive to the same signal set.

8. The cabinet according to claim 7, and configured such that one rotary actuator controllably fixes the position of each first member of the respective releasable latching mechanism between the forward latching position and retracted release position.

9. The cabinet according to claim 1, wherein the cabinet comprises drawers of two drawer types, a first drawer type, and a second drawer type, wherein drawers of the first drawer type are disposed with a releasable latching mechanism of a first releasable latching mechanism type, the first member of the releasable latching mechanism of the first releasable latching mechanism type being controllably fixable responsive to a first signal set between a forward latching position and a retracted release position and wherein drawers of the second drawer type are disposed with a releasable latching mechanism of a second releasable latching mechanism type, the first member of the releasable latching mechanism of the second releasable latching mechanism type being controllably fixable responsive to a second signal set between a forward latching position and a retracted release position.

10. The cabinet according to claim 9 further comprising a third drawer type, wherein the third drawer type is not disposed with any releasable latching mechanism and wherein the second drawer type is disposed with a first releasable latching mechanism and a second releasable latching mechanism, wherein the position of a first member of the first releasable latching mechanism is controllably fixable responsive to a first signal set between a forward latching position and retracted release position, and the position of a first member of the second releasable latching mechanism is controllably fixable responsive to a second signal set between a forward latching position and a retracted release position.

11. The cabinet according to claim 9, and comprising:

two rotary actuators, wherein a first rotary actuator is configured to controllably fix the position of each first member of the respective releasable latching mechanism of the first releasable latching mechanism type between the forward latching position and retracted release position; and wherein a second rotary actuator is configured to controllably fix the position of each first member of the respective actuator of the second actuator type between the forward latching position and the retracted release position.

12. The cabinet according to claim 9, wherein the first or second members are dismountable.

13. The cabinet according to claim 9, and further comprising a plurality of drawers each disposed with the first and second releasable latching mechanism, wherein the first members of the first releasable latching mechanism are controllably fixable between the forward latching position and retracted release position responsive to the same first signal set, and the first members of the second releasable latching mechanism are controllably fixable between the forward latching position and retracted release position responsive to the same second signal set.

14. A method for locking and unlocking a cabinet according to claim 9, wherein locking comprises:

providing a plurality of drawers in an open position, the drawers being disposed with a releasable latching mechanism having a first member and a second member, the first member and the second member being placed in a forward position;

closing the drawers, and while closing the drawers, maintaining the first member in a forward position, and pushing the second member to a retracted position by means of the first member;

returning the second member to its forward position by means of a compliant member, and latchingly engaging the a hook portion of the second member by means of a hook portion of the first member when the drawer is fully closed, thereby locking the drawers; and wherein opening comprises:

providing a plurality of drawers in a closed position, the drawers being disposed with a releasable latching mechanism having a first member and a second member, the first member and the second member being in a forward position, and a hook portion of the first member latchingly engaging with a hook portion of the second member;

moving the first member from its forward position to a retracted position by means of a rotary actuator, thereby unlocking the drawers;

opening the drawer.

15. A method for locking and/or unlocking a cabinet according to claim 1, wherein locking comprises:

providing a drawer in an open position, the drawer being disposed with a releasable latching mechanism having a first member and a second member, the first member and the second member being placed in a forward position;

closing the drawer, and while closing the drawer, maintaining the first member in a forward position, and pushing the second member to a retracted position by means of the first member;

returning the second member to its forward position by means of a compliant member, and latchingly engaging a hook portion of the second member by means of a hook portion of the first member when the drawer is fully closed, thereby locking the drawer; and wherein opening comprises:

providing a drawer in a closed position, the drawer being disposed with a releasable latching mechanism having a first member and a second member, the first member and the second member being in a forward position, and a hook portion of the first member latchingly engaging with a hook portion of the second member;

moving the first member from its forward position to a retracted position by means of a rotary actuator, thereby unlocking the drawer;

opening the drawer.

16. A cabinet comprising;

a frame;

a drawer supported by the frame;

a releasable latching mechanism for the drawer wherein the releasable latching mechanism is configured to lock the drawer in a drawer-closed position, and the releasable latching mechanism comprises:

a first member and a second member wherein the first member is positioned in relation to the frame and is configured to engage and releasably latch to the second member which is positioned in relation to the drawer wherein the first member is able to adopt to a forward latching position when the drawer is open, thereby allowing the drawer to be locked when the drawer is returned to the drawer-closed position, wherein the position of the first member is controllably fixable in response to a signal between a forward latching position and retracted release position and the second member is coupled to a compliant member configured to bias the second member in a forward position for latching with the first member in the forward latching position.

17. The cabinet according to claim 16, and further comprising a rotary actuator configured to rotate the first member between the forward latching position and the retracted release position responsive to the signal.

18. The cabinet according to claim 16, wherein the second member comprises a hook portion configured to latchingly engage with the first member.

19. The cabinet according to claim 16, wherein the first member comprises a hook portion configured to latchingly engage with the second member.

20. The cabinet according to claim 16, and further comprising a plurality of drawers each disposed with a releasable latching mechanism, wherein each first member of a respective releasable latching mechanism is controllably fixable between the forward latching position and retracted release position responsive to the same signal set.

* * * * *